US009222747B1

(12) United States Patent
Morrison

(10) Patent No.: US 9,222,747 B1
(45) Date of Patent: Dec. 29, 2015

(54) HINGED FIREARM SUPPRESSOR MOUNT

(71) Applicant: Robert Scott Morrison, Hoschton, GA (US)

(72) Inventor: Robert Scott Morrison, Hoschton, GA (US)

( * ) Notice: Subject to any disclaimer, the term of this patent is extended or adjusted under 35 U.S.C. 154(b) by 0 days.

(21) Appl. No.: 14/279,732

(22) Filed: May 16, 2014

Related U.S. Application Data

(60) Provisional application No. 61/923,692, filed on Jan. 5, 2014.

(51) Int. Cl.
*F41A 21/00* (2006.01)
*F41A 21/32* (2006.01)
*F41A 21/30* (2006.01)

(52) U.S. Cl.
CPC ..... *F41A 21/32* (2013.01); *F41A 21/30* (2013.01)

(58) Field of Classification Search
USPC ..... 89/14.2–14.4; 181/223
See application file for complete search history.

(56) References Cited

U.S. PATENT DOCUMENTS

| | | | | |
|---|---|---|---|---|
| 2,444,949 | A * | 7/1948 | Musser | 89/1.704 |
| 4,291,610 | A | 9/1981 | Waiser | |
| 4,530,417 | A | 7/1985 | Daniel | |
| 4,584,924 | A | 4/1986 | Taguchi | |
| 4,588,043 | A | 5/1986 | Finn | |
| 4,907,488 | A | 3/1990 | Seberger, Jr. | |
| 4,974,489 | A | 12/1990 | Fishbaugh | |
| 5,029,512 | A | 7/1991 | Latka | |
| 5,092,223 | A | 3/1992 | Hudson | |
| 5,164,535 | A | 11/1992 | Leasure | |
| 5,476,028 | A | 12/1995 | Seberger, Jr. | |
| 5,559,302 | A * | 9/1996 | Latka | 89/14.05 |
| 5,685,102 | A * | 11/1997 | Latka | 42/85 |
| 5,773,746 | A * | 6/1998 | Vaden | 89/14.4 |
| D415,812 | S | 10/1999 | Andrews, Jr. et al. | |
| 6,308,609 | B1 | 10/2001 | Davies | |
| 6,374,718 | B1 | 4/2002 | Rescigno et al. | |
| 6,385,891 | B1 * | 5/2002 | Rabatin | 42/79 |
| 6,575,074 | B1 | 6/2003 | Gaddini | |
| 6,619,179 | B2 * | 9/2003 | Mika | 89/14.05 |
| 6,973,863 | B1 * | 12/2005 | Jones | 89/14.2 |
| 7,073,426 | B1 | 7/2006 | White | |
| 7,325,474 | B2 | 2/2008 | Yoshimura et al. | |
| 7,610,710 | B2 * | 11/2009 | Brittingham | 89/14.4 |
| 8,096,222 | B2 | 1/2012 | Silvers | |
| 8,516,941 | B1 * | 8/2013 | Oliver | 89/14.4 |
| 2003/0019352 | A1 * | 1/2003 | Mika | 89/14.05 |
| 2007/0095198 | A1 * | 5/2007 | Dater et al. | 89/14.2 |
| 2007/0107590 | A1 | 5/2007 | Silvers | |
| 2007/0125351 | A1 * | 6/2007 | Campo et al. | 124/56 |
| 2008/0148928 | A1 * | 6/2008 | McClellan | 89/14.4 |
| 2010/0313743 | A1 * | 12/2010 | Dueck et al. | 89/14.05 |
| 2011/0154711 | A1 * | 6/2011 | Dickerson et al. | 42/107 |
| 2013/0263490 | A1 * | 10/2013 | Oliver | 42/90 |

* cited by examiner

*Primary Examiner* — Samir Abdosh
(74) *Attorney, Agent, or Firm* — Hartman & Citrin LLC

(57) ABSTRACT

Embodiments of a hinged firearm suppressor mount are disclosed herein. According to various embodiments, the hinged firearm suppressor mount can include a suppressor attachment portion that has an attachment surface and a first structure that houses a first assembly passageway. The hinged firearm suppressor mount also can include a firearm attachment portion that includes a firearm attachment surface and a second structure that houses a second assembly passageway. An assembly mechanism can be passed through the first structure and the second structure to connect the attachment portion to the suppressor attachment portion.

18 Claims, 9 Drawing Sheets

HINGED FIREARM SUPPRESSOR MOUNT

CROSS-REFERENCE TO RELATED APPLICATIONS

This application claims priority to U.S. Provisional Patent Application No. 61/923,692, filed Jan. 5, 2014, entitled "Suppressor Mounting Hinge," which is incorporated herein by reference in its entirety.

TECHNICAL FIELD

This disclosure relates generally to firearm technologies. More particularly, the disclosure made herein relates to a hinged firearm suppressor mount that enables quick mounting and removal of a firearm suppressor from a firearm.

BACKGROUND

Unless otherwise indicated herein, the details in this section are not prior art to the claims in this application and are not admitted to be prior art by inclusion in this section.

Firearm suppressors are sometimes referred to as "silencers." The term "silencer," however, while being partially accurate, does not explain or identify the various functions of a well-manufactured and well-used suppressor. In particular, a suppressor functions to not only suppress an audible signature of a firearm, but also to suppress the muzzle flash and other visible signatures of firearms. As such, suppressors can be used to allow firearm use without personal hearing protection by a shooter. In military applications, suppressors can reduce detectability, thereby allowing soldiers or other entities to discharge firearms without revealing their location. Soldiers also may use suppressors to discharge firearms without compromising their ability to hear other sounds in their environment.

Because suppressors can allow shooters to discharge firearms without personal hearing protection, and may reduce the muzzle flash and other visible effects of firearm discharge, suppressors have become popular accessories with shooters. In fact, some shooters wish to acquire a suppressor for each owned firearm after firing a suppressed firearm due to the reduced sound and flash of a firearm discharge. In general, suppressors can make shooting more enjoyable.

The benefits of suppressors, however, are not limited to comfort and enjoyment. Suppressors also can be used for personal defense, military applications, hunting, and the like. In particular, because adrenaline-inducing events can result in visual distortion such as tunnel vision, depth perception issues, and the like, which may pose personal safety risks, some firearm owners equip personal defense firearms with suppressors to reduce the likelihood of such issues in a violent encounter. For military applications, suppressors can aid soldiers in stealthily attacking targets with firearms by reducing the detectability of the firearms visually and audibly.

For these and other reasons, suppressors have become popular accessories for firearm owners and users. Suppressors, however, are expensive to make and therefore are expensive to own. Additionally, the regulatory framework around suppressor manufacturing and ownership combine with the high cost of manufacturing to result in limited suppressor ownership and availability. In general, suppressors function by dissipating high pressure gases between the muzzle and an ambient environment. As such, the greater the dissipation of these gases, the more effective the suppressor.

In certain situations, however, the use of a suppressor may be impractical or inadvisable. In particular, an automatic firearm generally cannot be operated with a suppressor, since the heat and pressure generated during full automatic fire can exceed the survivable temperatures and/or pressures for the suppressor. Removing the suppressor from a firearm, however, can require tools, lubricants, or the like, as the suppressor and firearm sometimes are stuck together by powder residue, or the like, or because expansion and contraction of the suppressor and/or firearm during operation can lock the suppressor in place. Thus, it may be difficult to remove a suppressor from a firearm, which can be a serious problem in some military, law enforcement, and/or sporting scenarios.

SUMMARY

Concepts and technologies are disclosed herein for a hinged firearm suppressor mount. In some embodiments, a hinged firearm suppressor mount can be formed from a firearm attachment portion and a firearm suppressor portion. The firearm attachment portion can be configured to engage a firearm, and the firearm suppressor portion can be configured to engage a firearm suppressor. The firearm and the firearm suppressor can be attached to and/or can engage the firearm attachment portion and the firearm suppressor portion, respectively, via threads or other mechanical structures; welds, adhesives, or other mechanical or chemical fasteners; combinations thereof; or the like.

The firearm suppressor can be rotated into or out of an operating arrangement by rotating the firearm suppressor portion about an axis that can be provided by a hinge or other assembly mechanism. Thus, the firearm suppressor can quickly and easily be rotated into or out of an operating arrangement without removing the firearm suppressor from the hinged firearm suppressor mount.

According to one aspect of the concepts and technologies described herein, a hinged firearm suppressor mount is disclosed. The hinged firearm suppressor mount can include a firearm suppressor portion. The firearm suppressor portion can include an attachment surface and a first structure that can house a first assembly passageway. The hinged firearm suppressor mount also can include a firearm attachment portion. The firearm attachment portion can include a firearm attachment surface and a second structure that can house a second assembly passageway. The hinged firearm suppressor mount also can include an assembly mechanism. The assembly mechanism can pass through the first structure and the second structure, and can connect the firearm attachment portion to the firearm suppressor portion.

In some embodiments, a firearm suppressor can be attached to the firearm suppressor portion at the attachment surface. The firearm suppressor can be attached to the firearm suppressor portion via threads located at the attachment surface. In some embodiments, a firearm can be attached to the firearm attachment portion at the firearm attachment surface. The firearm can be attached to the firearm attachment portion via threads located at the firearm attachment surface.

In some embodiments, the first structure can include a first knuckle, the second structure can include a second knuckle, and the assembly mechanism can include a hinge. In some embodiments, the firearm suppressor portion can include a tapered surface. In some embodiments, the first attachment surface can include two attachment surfaces, and in some embodiments, the second attachment surface can include two attachment surfaces. The hinged firearm suppressor mount also can include a gasket. The gasket can be located between the firearm attachment portion and the firearm suppressor portion. In some embodiments, the hinged firearm suppressor mount can include a mechanism to lock the firearm attachment portion and the firearm suppressor portion in a position with respect to one another. The mechanism can include a latch.

According to another aspect of the concepts and technologies described herein, a hinged firearm suppressor mount is disclosed. The hinged firearm suppressor mount can include a firearm suppressor portion that can include an attachment surface and a first structure including a first assembly passageway. The hinged firearm suppressor mount also can include a firearm attachment portion. The firearm attachment portion can include a firearm attachment surface and a second structure including a second assembly passageway. The hinged firearm suppressor mount also can include an assembly mechanism. The assembly mechanism can pass through the first assembly passageway and the second assembly passageway. The assembly mechanism can connect the firearm attachment portion to the firearm suppressor portion. The assembly mechanism also can provide an axis about which at least one of the firearm attachment portion and the firearm suppressor portion can rotate.

In some embodiments, the first structure can include a first knuckle, the second structure can include a second knuckle, and the assembly mechanism can include a hinge. In some embodiments, a firearm suppressor can be attached to the firearm suppressor portion at the attachment surface, and a firearm can be attached to the firearm attachment portion at the firearm attachment surface. In some embodiments, the firearm suppressor can be moved into and out of an operating position by rotating the firearm attachment portion or the firearm suppressor portion about the axis.

According to yet another aspect of the concepts and technologies described herein, a hinged firearm suppressor mount is disclosed. The hinged firearm suppressor mount can include a firearm suppressor portion. The firearm suppressor portion can include an attachment surface that can engage a firearm suppressor, and a first assembly passageway. The hinged firearm suppressor mount also can include a firearm attachment portion. The firearm attachment portion can include a firearm attachment surface that can engage a firearm, and a second assembly passageway. The hinged firearm suppressor mount also can include an assembly mechanism. The assembly mechanism can pass through the first assembly passageway and the second assembly passageway. The assembly mechanism can connect the firearm attachment portion to the firearm suppressor portion, and can provide an axis about which at least one of the firearm attachment portion and the firearm suppressor portion can be rotated.

In some embodiments, the hinged firearm suppressor mount can include a first knuckle in which the first assembly passageway can be located, and a second knuckle in which the second assembly passageway can be located. In some embodiments, the assembly mechanism can include a hinge or hinge pin. In some embodiments, the firearm suppressor can be attached to the firearm suppressor portion at the attachment surface, and the firearm can be attached to the firearm attachment portion at the firearm attachment surface. In some embodiments, the firearm suppressor can be moved into an operating position and out of the operating position by rotating the firearm attachment portion or the firearm suppressor portion about the axis.

The foregoing summary is illustrative only and is not in any way limiting. In addition to the illustrative aspects, embodiments, and features described above, further aspects, embodiments, and features will become apparent by reference to the drawings and the following detailed description.

DETAILED DESCRIPTION

Figure 1:
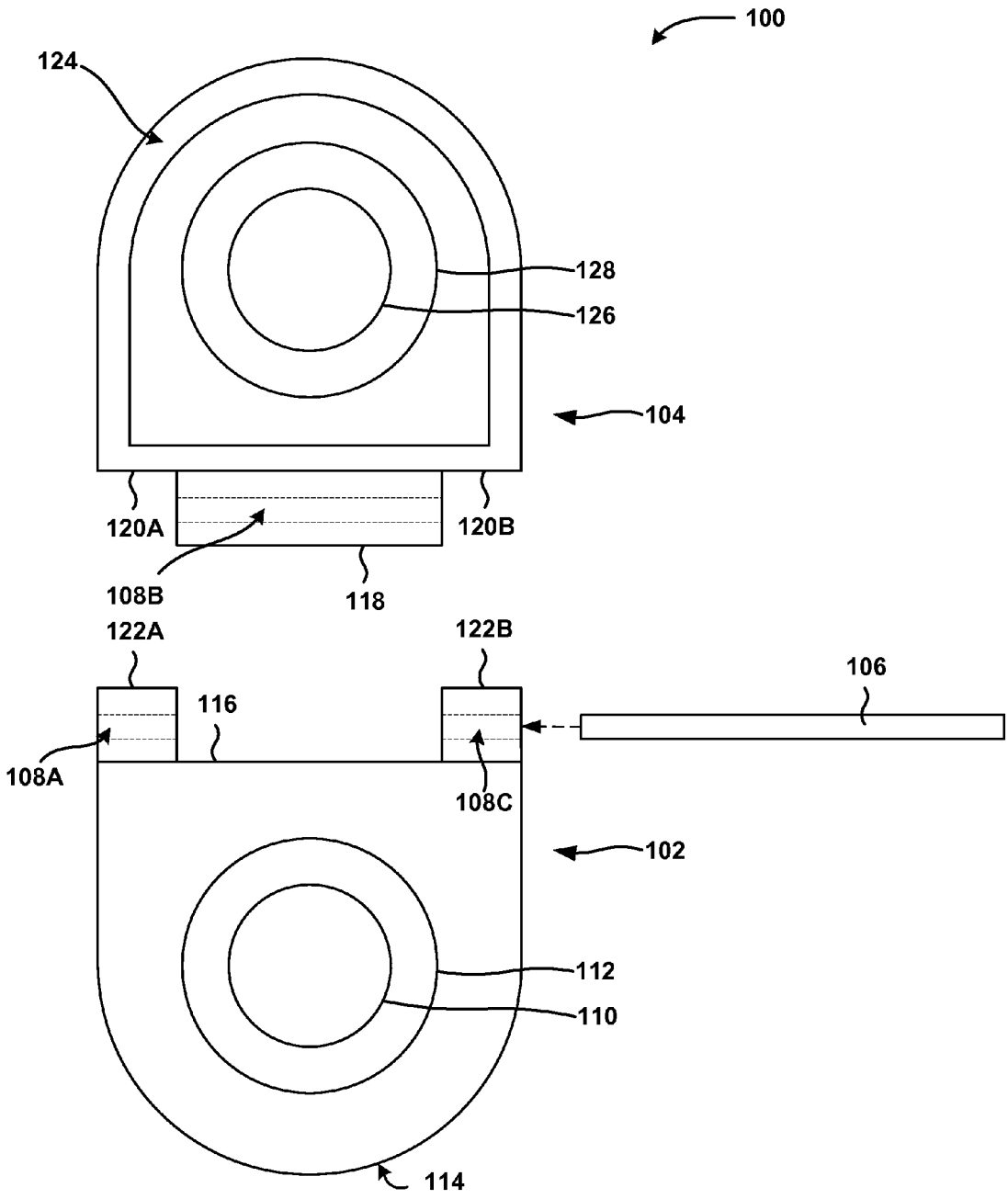
FIG. 1 is an assembly drawing showing some components of a hinged firearm suppressor mount, according to an illustrative embodiment of the concepts and technologies described herein.

The following detailed description is directed to a hinged firearm suppressor mount. In some embodiments a hinged firearm suppressor mount can be formed from a firearm attachment portion and a firearm suppressor portion. The firearm attachment portion can be configured to engage a firearm, and the firearm suppressor portion can be configured to engage a firearm suppressor. The firearm and the firearm suppressor can be attached to and/or can engage the firearm attachment portion and the firearm suppressor portion, respectively, via threads or other mechanical structures; welds, adhesives, or other mechanical or chemical fasteners; combinations thereof; or the like.

The firearm suppressor can be rotated into or out of an operating arrangement by rotating the firearm suppressor portion about an axis that can be provided by a hinge or other assembly mechanism. Thus, the firearm suppressor can quickly and easily be rotated into or out of an operating arrangement without removing the firearm suppressor from the hinged firearm suppressor mount. These and other aspects of the concepts and technologies described herein will be described herein in further detail.

In the following detailed description, references are made to the accompanying drawings that form a part hereof, and in which are shown by way of illustration specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of hinged firearm suppressor mounts will be presented.

Turning to FIG. 1, aspects of a hinged firearm suppressor mount 100 according to various embodiments of the concepts and technologies described herein will be described in detail. In particular, FIG. 1 illustrates one illustrative embodiment of a hinged firearm suppressor mount 100. It should be understood that the illustrated and described illustrative embodiment of the hinged firearm suppressor mount 100 is one illustrative embodiment of the concepts and technologies described herein, and therefore should not be construed as being limiting in any way of the concepts and technologies described herein.

In some embodiments, as shown in FIG. 1, a hinged firearm suppressor mount 100 can include a suppressor attachment portion 102 and a firearm attachment portion 104. The suppressor attachment portion 102 can be configured to engage, attach to, connect, or mate with a firearm suppressor, as will be explained in more detail hereinbelow. The firearm attachment portion 104 can be configured to engage, attach to, connect, or mate with a portion of a firearm (not shown) as will be illustrated and described in more detail hereinbelow.

The suppressor attachment portion 102 and the firearm attachment portion 104 can be assembled together. In some embodiments, the suppressor attachment portion 102 and the firearm attachment portion 104 can be assembled together using an assembly mechanism 106. The assembly mechanism 106 can include, for example, a pin, a bolt, a rivet, a screw, a latch, and/or other mechanisms. In one contemplated embodiment, the assembly mechanism 106 includes a pin that can be inserted through one or more assembly mechanism passageways 108A-108C. According to various embodiments of the concepts and technologies described herein, the assembly mechanism 106 can be removable and/or can be removed from the hinged firearm suppressor mount 100. The one or more assembly mechanism passageways 108A-108C can cooperatively form an assembly passageway (as can be seen in FIG. 2C).

In some embodiments, the assembly mechanism 106 can be inserted through the one or more assembly mechanism passageways 108A-108C (and/or the assembly passageway), and a securing mechanism such as a lynchpin, nut, or the like can be attached to the assembly mechanism 106 to hold the assembly mechanism in position. Additionally, or alternatively, if a permanent or semi-permanent fastener is used as the assembly mechanism 106, the assembly mechanism 106 can be inserted into the assembly mechanism passageways 108A-108C (and/or the assembly passageway), and the assembly mechanism 106 can be deformed, welded, and/or otherwise permanently or semi-permanently locked into position. In one contemplated embodiment, wherein the functionality of the assembly mechanism 106 is provided by a rivet, the assembly mechanism 106 can be inserted through the one or more assembly mechanism passageways 108A-108C, and a buck-tail of the assembly mechanism 106 can be deformed (e.g., bucked). It should be understood that this example is illustrative and therefore should not be construed as being limiting in any way. Because various types of fasteners that can be used as the assembly mechanism 106 are generally understood, the assembly mechanism 106 will not be described in further detail.

According to some embodiments, the suppressor attachment portion 102 is configured to support attachment of a firearm suppressor or other device or structure, as will be more easily seen with reference to FIGS. 3A-4F below. Briefly, the suppressor attachment portion 102 can include a firearm suppressor attachment structure or surface ("suppressor attachment surface") 110. In some embodiments, the suppressor attachment surface 110 can be cylindrical, though this is not necessarily the case. In some embodiments, wherein the suppressor attachment surface 110 is cylindrical 110, the suppressor attachment surface 110 can have a radius. The suppressor attachment surface 110 also can have attachment structures for mating with and/or engaging a suppressor (not visible in FIG. 1). For example, the suppressor attachment surface 110 can have threads or other mechanisms for engaging a firearm suppressor and/or structures or surfaces of a firearm suppressor. In another embodiment, the suppressor attachment surface 110 can be configured to support welding or other attachment of a firearm suppressor. Because firearm suppressors can be attached to the suppressor attachment surface 110 in various ways, it should be understood that these examples are illustrative and therefore should not be construed as being limiting in any way.

In some other embodiments, as shown in FIG. 1, the suppressor attachment surface 110 can include two or more surfaces. In the embodiment shown in FIG. 1, a first attachment surface (labeled 110 in FIG. 1) can have a first radius, and a second attachment surface 112 can have a second radius. Thus, the suppressor attachment surface 110 can support various types and/or sizes of firearm suppressors. As noted above, the attachment surfaces 110, 112 need not be round, and as such the example of two radii is illustrative and should not be construed as being limiting in any way.

In some embodiments, firearm suppressors can be welded, clamped, or otherwise attached to the suppressor attachment portion 102 at the first attachment surface 110 and/or the second attachment surface 112. In some other embodiments, firearm suppressors may be attached to the suppressor attachment portion 102 using various other attachment mechanisms, methods, and/or devices. In one contemplated embodiment, the second attachment surface 112 can include threads that can engage reciprocal threads of a firearm suppressor. As such, the suppressor attachment portion 102 can be configured to support attachment of various types and/or shapes of firearm suppressors, in some embodiments. It therefore should be understood that the illustrated example is illustrative of one contemplated embodiment and therefore should not be construed as being limiting in any way.

The shape of the suppressor attachment portion 102 can be varied for various purposes and/or applications. In the illustrated embodiment, the suppressor attachment portion 102 can include a rounded edge 114. The rounded edge 114 can be included for aesthetic purposes and/or for functional purposes. In particular, the rounded edge 114 can be included to reduce the possibility of snagging and/or catching materials or surfaces by the surface located at the rounded edge 114. In some other embodiments, the rounded edge 114 can be included for aesthetic purposes. For example, the rounded edge 114 may be included to provide a smooth or rounded appearance for the hinged firearm suppressor mount 100.

In some embodiments, the rounded edge 114 may be omitted from the suppressor attachment portion 102 and/or can be replaced with surfaces having alternative shapes and/or configurations. For example, the rounded edge 114 can be replaced with a flat edge or surface, an irregularly shaped edge or surface, or the like. In one contemplated embodiment, the rounded edge 114 can be replaced with a hexagonally-shaped surface for aesthetic, functional, and/or other purposes. In some other embodiments, the rounded edge 114 can be included to ensure that the firearm attachment portion 104 and the suppressor attachment portion 102 can rotate with respect to one another. It should be understood that these examples are illustrative and therefore should not be construed as being limiting in any way.

Although not clearly visible in FIG. 1, the suppressor attachment portion 102 also can include a rounded attachment edge 116. The rounded attachment edge 116 can include a surface that interfaces with a reciprocal attachment surface 118 of the firearm attachment portion 104. The rounded attachment edge 116 can be included for aesthetic purposes and/or for functional purposes as explained above with regard to the rounded edge 114. For example, the rounded attachment edge 116 can be included to reduce snagging, to reduce effort required to rotate the suppressor attachment portion 102 and/or the firearm attachment portion 104, combinations thereof, or the like. In some other embodiments, the rounded attachment edge 116 can be included to ensure that the firearm attachment portion 104 and the suppressor attachment portion 102 can rotate with respect to one another (e.g., to prevent binding that may occur if two flat surfaces with tight tolerances are connected together and rotated with respect to one another). Because the rounded attachment edge 116 can be included for additional and/or alternative purposes, and because the rounded attachment edge 116 can be substituted with other shapes of surfaces, it should be understood that these examples are illustrative and therefore should not be construed as being limiting in any way.

The shape of the firearm attachment portion 104 can be varied for various purposes and/or applications. In the illustrated embodiment, the firearm attachment portion 104 can include rounded nesting edges 120A-120B. The rounded nesting edges 120A-120B can be included for aesthetic purposes and/or for functional purposes. In particular, the rounded nesting edges 120A-120B can be included to reduce the possibility of snagging and/or catching and/or for other purposes. In some other embodiments, the rounded nesting edges 120A-120B can be included to ensure that the firearm attachment portion 104 and the suppressor attachment portion 102 can rotate with respect to one another. In particular, the rounded nesting edges 120A-120B can be included to reduce binding and/or contact between the rounded nesting edges 120A-120B and the nesting surfaces 122A-122B of the suppressor attachment portion 102 as explained above with regard to the rounded attachment edge 116. It should be understood that this example is illustrative and therefore should not be construed as being limiting in any way.

In some embodiments, the firearm attachment portion 104 can include a tapered surface 124. The tapered surface 124 can be included for functional and/or aesthetic purposes. In particular, the tapered surface 124 can be included to reduce snagging, to provide a smooth appearance, to help users distinguish between a portion of the hinged firearm suppressor mount 100 that engages a firearm and a portion of the hinged firearm suppressor mount 100 that engages a firearm suppressor, and/or for other purposes. Contours of one embodiment of the tapered surface 124 are more easily seen with reference to FIGS. 2A-2E. Because the tapered surface 124 can be omitted in some embodiments, it should be understood that the illustrated examples are illustrative and therefore should not be construed as being limiting in any way.

The firearm attachment portion 104 also can include a firearm attachment surface 126 that can be configured to mate with and/or engage a firearm and/or a structure of a firearm such as a barrel, a flash suppressor, combinations thereof, or the like. In some embodiments, the firearm attachment surface 126 can be cylindrical and can have a radius and/or attachment structures for mating with and/or engaging a barrel or other structure of a firearm (not visible in FIG. 1). For example, the firearm attachment surface 126 can have threads or other mechanisms that can engage a barrel of a firearm and/or other structures or surfaces of a firearm.

In some other embodiments (as shown in FIG. 1), the firearm attachment surface 126 can be provided by two or more surfaces, and/or by one surface that is irregular, tapered, or the like. In the embodiment shown in FIG. 1, a first firearm attachment surface (labeled 126 in FIG. 1) can have a first radius, and a second firearm attachment surface 128 can have a second radius. As noted above, the firearm attachment surfaces 126, 128 are not necessarily round or cylindrical, and as such the example of various radii should be understood as being illustrative and not limiting in any way. Thus, the firearm attachment surface 126 can support various types and/or sizes of firearms, barrels, and/or other components and/or structures. It should be understood that these examples are illustrative and therefore should not be construed as being limiting in any way.

The hinged firearm suppressor mount 100 and/or the components of the hinged firearm suppressor mount 100 (e.g., the suppressor attachment portion 102, the firearm attachment portion 104, and/or the assembly mechanism 106) can be formed from various materials. According to various embodiments of the concepts and technologies described herein, the hinged firearm suppressor mount 100, or portions or components thereof, can be formed from metals and/or metal alloys such as steel, aluminum, titanium, brass, copper, magnesium alloys, aluminum alloys, other metals or alloys, combinations thereof, or the like. In some embodiments, one or more components of the hinged firearm suppressor mount 100 can be formed from non-metal and/or non-metal-alloy materials such as resins, polymers, and/or other materials. In some embodiments, for example, the hinged firearm suppressor mount 100, or a portion thereof, can be formed from resins such as epoxy resins, or the like. In some embodiments, for example, the hinged firearm suppressor mount 100, or a portion thereof, can be formed from one or more polymers such as various thermoplastics, polypropylene, polycarbonates, aerogel, graphite filled NYLON, phenolics, polyimides, and/or other polymers, combinations thereof, or the like. Because the hinged firearm suppressor mount 100 can be formed from additional and/or alternative materials, it should be understood that these examples are illustrative and therefore should not be construed as being limiting in any way.

The hinged firearm suppressor mount 100 and/or the components of the hinged firearm suppressor mount 100 (e.g., the suppressor attachment portion 102, the firearm attachment portion 104, and/or the assembly mechanism 106) also can be formed in various ways from the materials used. In particular, the hinged firearm suppressor mount 100 and/or the components of the hinged firearm suppressor mount 100 (e.g., the suppressor attachment portion 102, the firearm attachment portion 104, and/or the assembly mechanism 106) from an assembly of two or more components. In some other embodiments, the suppressor attachment portion 102 and/or the firearm attachment portion 104 can be formed from a single piece of material that can be machined, casted, forged, and/or otherwise formed or machined using various processes and/or tooling. Because the hinged firearm suppressor mount 100 and/or the components of the hinged firearm suppressor mount 100 (e.g., the suppressor attachment portion 102, the firearm attachment portion 104, and/or the assembly mechanism 106) can be formed using various manufacturing and/or forming techniques, it should be understood that these examples are illustrative and therefore should not be construed as being limiting in any way.

In some embodiments, one or more surfaces of the hinged firearm suppressor mount 100 and/or the components of the hinged firearm suppressor mount 100 (e.g., the suppressor attachment portion 102, the firearm attachment portion 104, and/or the assembly mechanism 106) can be treated or surface treated for various purposes. According to various embodiments of the concepts and technologies described herein, the hinged firearm suppressor mount 100 and/or the components of the hinged firearm suppressor mount 100 (e.g., the suppressor attachment portion 102, the firearm attachment portion 104, and/or the assembly mechanism 106) can be polished, sandblasted, anodized, or otherwise treated to provide a shiny, satin, unfinished, anodized, or other surface appearance. Furthermore, various embodiments of the concepts and technologies described herein include heat treating the hinged firearm suppressor mount 100 and/or the components of the hinged firearm suppressor mount 100 (e.g., the suppressor attachment portion 102, the firearm attachment portion 104, and/or the assembly mechanism 106) to harden the hinged firearm suppressor mount 100, to provide a heat-induced decorative appearance for the hinged firearm suppressor mount 100, or for other purposes. Because additional and/or alternative treatment processes are possible and are contemplated, it should be understood that these examples are illustrative and therefore should not be construed as being limiting in any way.

Figure 2B:
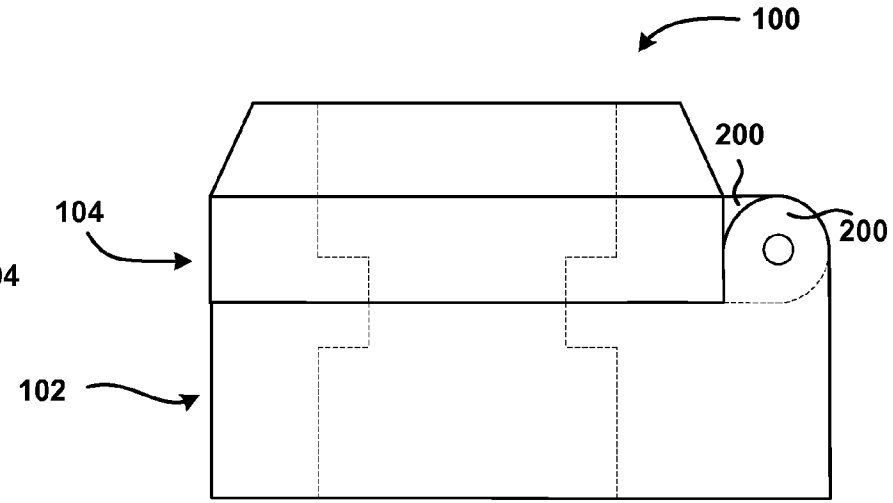
FIGS. 2A-2E are line drawings illustrating various views of a hinged firearm suppressor mount, according to an illustrative embodiment of the concepts and technologies described herein.
Figure 2A:
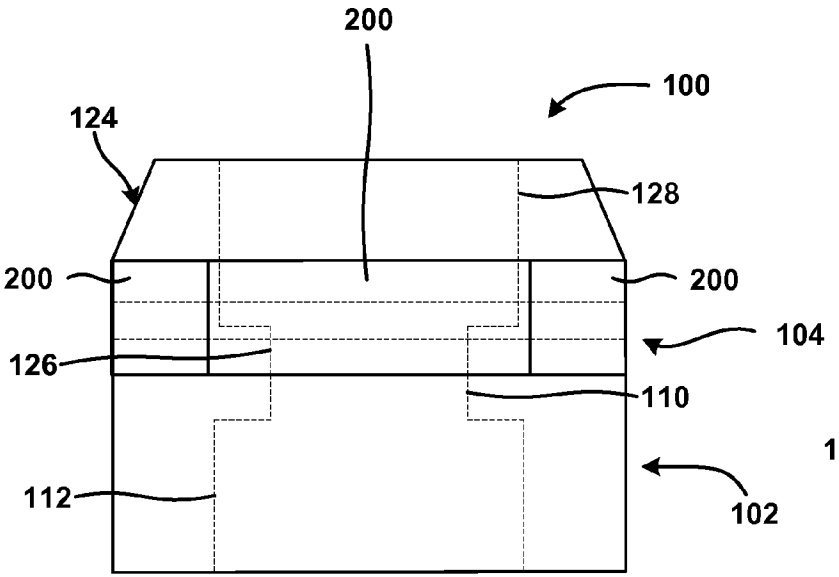
Figure 2C:
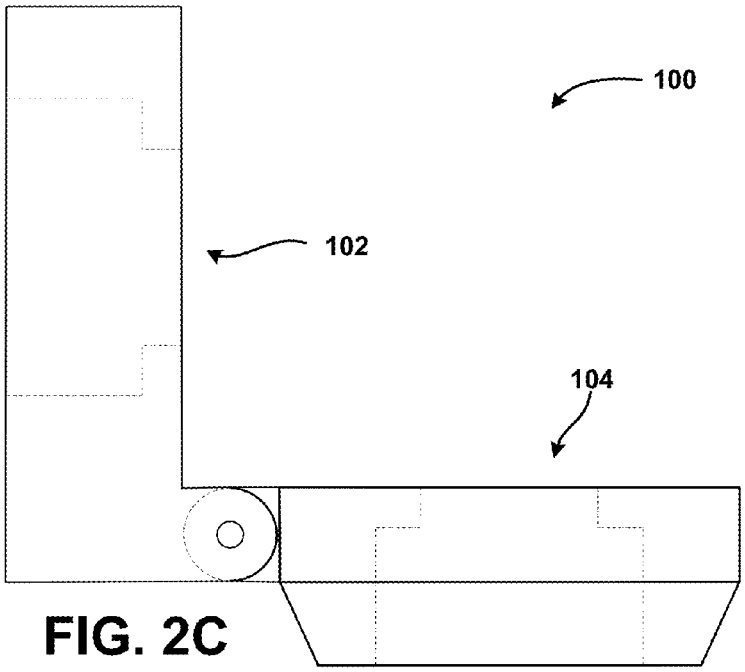

Turning now to FIGS. 2A-2E, additional aspects of the concepts and technologies described herein for a hinged firearm suppressor mount 100 will be described in additional detail. In particular, FIG. 2A is a line drawing showing an assembled hinged firearm suppressor mount 100, according to an illustrative embodiment. As can be seen in FIG. 2A, the suppressor attachment portion 102, the firearm attachment portion 104, and the assembly mechanism 106 can be assembled together to form the hinged firearm suppressor mount 100. As can be seen in FIG. 2A, the suppressor attachment portion 102 and the firearm attachment portion 104 can contact one another.

As can be seen with reference to FIG. 2A, the first attachment surface 110 and the first firearm attachment surface 126 can be aligned with one another via arranging the suppressor attachment portion 102 in contact with the firearm attachment portion 104. Similarly, the second attachment surface 112 and the second firearm attachment surface 128 can be aligned with one another via arranging the suppressor attachment portion 102 in contact with the firearm attachment portion 104. As such, the attachment surfaces 110, 112 and the firearm attachment surfaces 126, 128 can cooperate with and/or be aligned with one another to create a passageway for a projectile such as a bullet and/or to provide a passageway for hot and/or expanding gases from the barrel into a firearm suppressor.

As can be seen with reference to FIG. 2A, the suppressor attachment portion 102 can include one or more hinge knuckles ("knuckles) 200, in some embodiments. Similarly, the firearm attachment portion 104 can include one or more knuckles 200. Thus, the knuckles 200 can provide a structure through which the assembly mechanism passageways 108A-108C are located, and the assembly mechanism 106 can act as a hinge for hinged firearm suppressor mount 100. Thus, the knuckles 200 can house one or more of the assembly mechanism passageways 108A-108C disclosed herein. It should be understood that this example is illustrative and therefore should not be construed as being limiting in any way.

While in the illustrated embodiment the suppressor attachment portion 102 includes two knuckles 200 and the firearm attachment portion 104 includes one knuckle 200, it should be understood that this arrangement is illustrative and therefore should not be construed as being limiting in any way. In particular, the suppressor attachment portion 102 can include one knuckle 200 and the firearm attachment portion 104 can include two knuckles 200. Alternatively, the suppressor attachment portion 102 can include one, two, or more than two knuckles 200 and the firearm attachment portion 104 can include one, two, or more than two knuckles 200. As such, the illustrated embodiment is illustrative and therefore should not be construed as being limiting in any way.

FIG. 2B is a line drawing showing another view of the hinged firearm suppressor mount 100 shown in FIG. 2A, according to an illustrative embodiment. In FIG. 2B, two of the knuckles 200 are visible. With reference to FIG. 2B, it can be appreciated how the suppressor attachment portion 102 and the firearm attachment portion 104 can be connected together and how these components of the hinged firearm suppressor mount 100 can rotate with respect to one another about the assembly mechanism 106. It should be understood that this example is illustrative and therefore should not be construed as being limiting in any way.

Figure 2D:
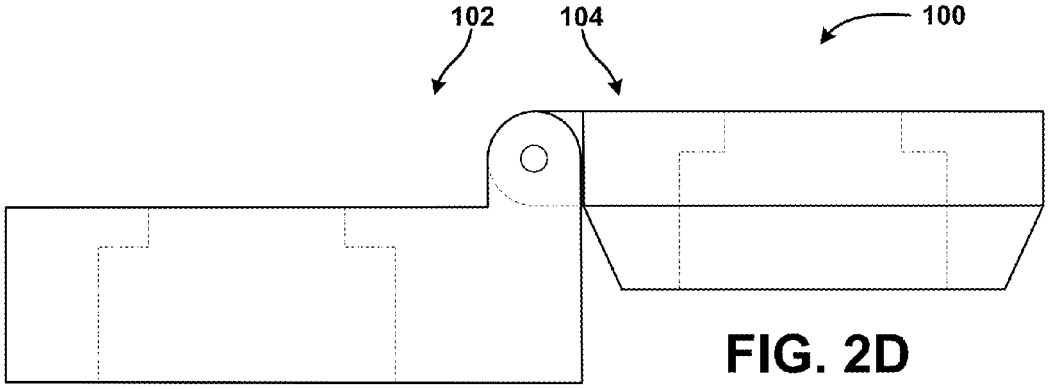

Rotation of the suppressor attachment portion 102 and the firearm attachment portion 104 is shown in FIGS. 2C-2D. Because the suppressor attachment portion 102 and the firearm attachment portion 104 can have other configurations, it should be understood that the illustrated example shown in FIGS. 2A-2D is illustrative and therefore should not be construed as being limiting in any way.

Figure 2E:
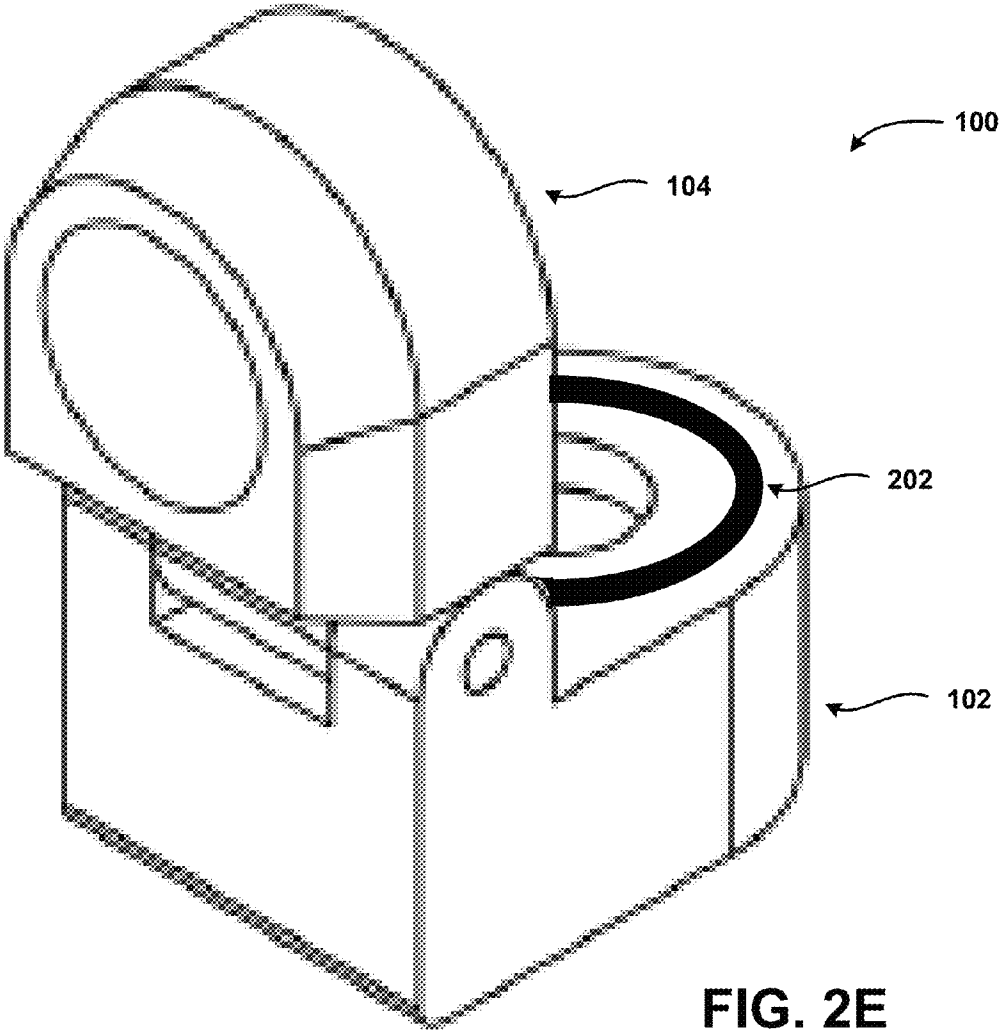

FIG. 2E shows a perspective view of the hinged firearm suppressor mount 100, according to one embodiment. In the embodiment shown in FIG. 2E, a gasket 202 can be seen. The gasket 202 can be provided to seal the hinged firearm suppressor mount 100 to prevent (or at least reduce) leakage of hot gases and/or pressure between the firearm attachment portion 104 and the suppressor attachment portion 102. The gasket 202 can be made from various materials such as, for example, metals, alloys, polymers or aramids such as Teflon, silicone, Kevlar, woods or wood-based materials such as cork, other materials, combinations thereof, or the like. In some embodiments, the gasket 202 shown in FIG. 2E can be replaced with and/or supplemented by a tongue and groove formed in the suppressor attachment portion 102 and/or the firearm attachment portion 104. As such, it should be understood that example shown in FIG. 2E is illustrative of one contemplated embodiment and therefore should not be construed as being limiting in any way.

Figure 3A:
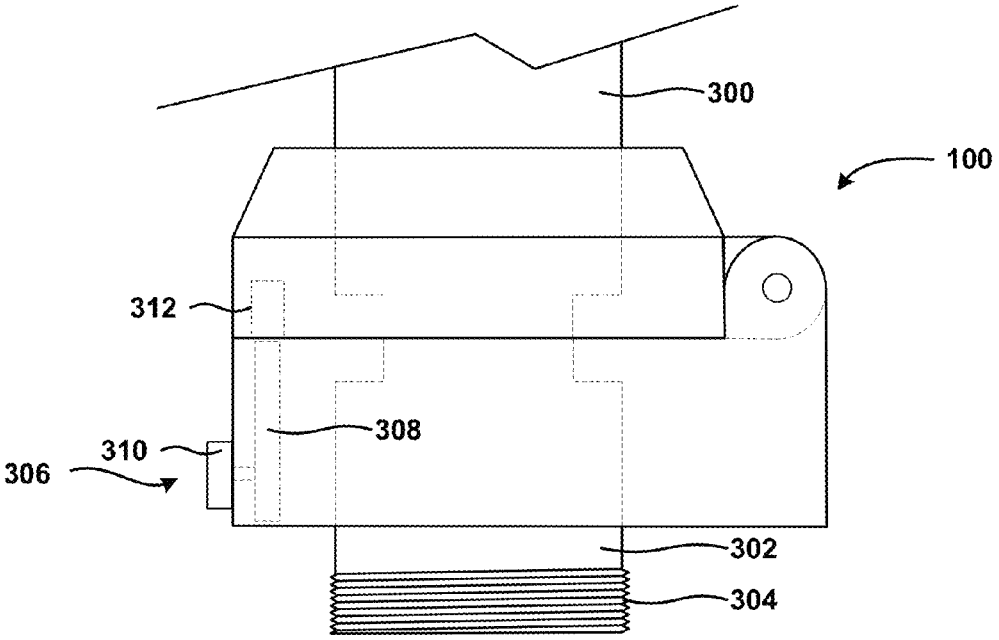
FIGS. 3A-3B are line drawings illustrating additional features of a hinged firearm suppressor mount, according to some illustrative embodiments of the concepts and technologies described herein.
Figure 3B:
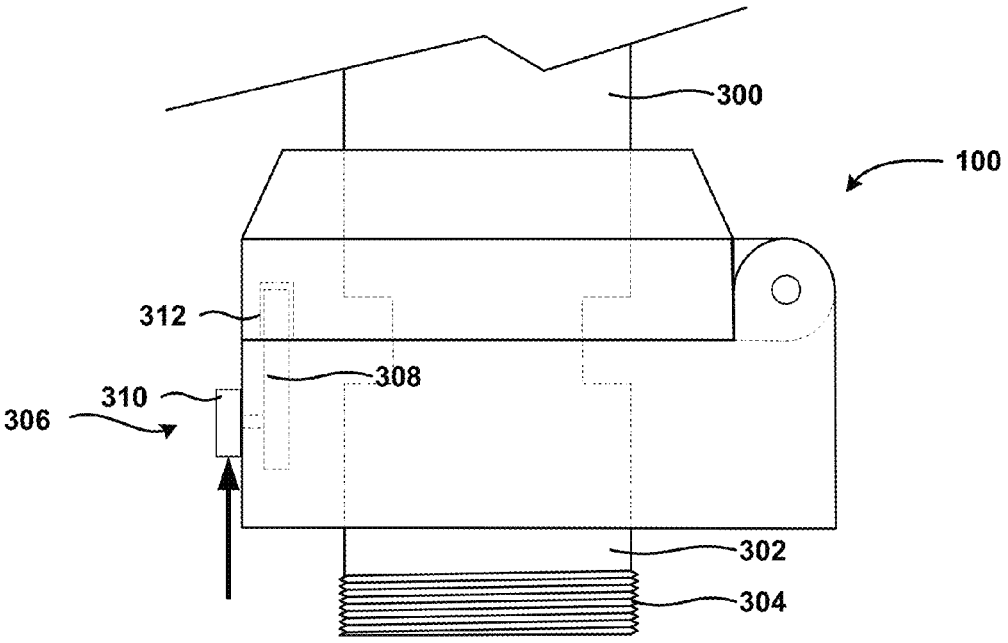

Turning now to FIGS. 3A-3B, additional aspects of the concepts and technologies described herein for a hinged firearm suppressor mount 100 will be described in additional detail. In particular, FIGS. 3A-3B are line drawings showing an assembled hinged firearm suppressor mount 100, according to another illustrative embodiment. As can be seen in FIG. 3A, the firearm attachment portion 104 can engage, mate with, be attached to, and/or be connected to a firearm structure such as, for example, a barrel 300. As explained in detail above, the barrel 300 or other firearm structure can be configured with threads that engage one or more of the attachment surfaces 110, 112. In some embodiments, the barrel 300 or other firearm structure can be welded, clamped, pinned, and/or otherwise attached to the firearm attachment portion 104. In some embodiments, a taper mount can be used to secure and/or align the barrel 300 with the hinged firearm suppressor mount 100. As such, the illustrated embodiment, wherein the barrel 300 engages one or more of the firearm attachment surfaces 126, 128 via threads formed on the barrel 300 and/or the attachment surfaces 126, 128, is illustrative and should not be construed as being limiting in any way.

Similarly, the suppressor attachment portion 102 can engage, mate with, be attached to, and/or be connected to a firearm suppressor or other structure. In the illustrated embodiment, the suppressor attachment portion 102 can engage a suppressor coupling 302. The suppressor coupling 302 can be a tubular or cylindrical structure that includes threads 304. Although not visible in FIGS. 3A-3B, the other end of the suppressor coupling 302 also can be threaded and can engage one or more of the attachment surfaces 110, 112. In some embodiments, the suppressor coupling 302 or other structure can instead (or additionally) be welded, clamped, pinned, and/or otherwise attached to the suppressor attachment portion 102.

The hinged firearm suppressor mount 100 also can include a latch or other mechanism ("latch") 306. The latch 306 can hold or lock the suppressor attachment portion 102 and the firearm attachment portion 104 in an assembled position with respect to one another. Thus, the latch 306 can prevent disassembly of the hinged firearm suppressor mount 100 during firing, for example due to expanding gases. Thus, the latch 306 also can be used to prevent bullet strikes within the firearm suppressor, or the like.

According to some embodiments, the latch 306 can include a post 308, which can be connected to a handle 310. Via manipulation of the handle 310 (as can be seen with collective reference to FIGS. 3A-3B), the post 308 can extend into a post aperture 312. The post 308 can, via being located within the post aperture 312, prevent opening of the hinged firearm suppressor mount 100. Because the latch 306 can be replaced with other structures and/or devices for locking the hinged firearm suppressor mount 100 in an open or closed position, it should be understood that this example is illustrative and therefore should not be construed as being limiting in any way. Some example mechanisms that can be used in addition to, or instead of, the latch 306 include, but are not limited to, a detent, magnetic fasteners or fastening mechanisms, or the like. In some other embodiments, the latch 306 can be replaced with (or supplemented by) pressure fit surfaces on the suppressor attachment portion 102 and/or the firearm attachment portion 104, clamps on the suppressor attachment portion 102 and/or the firearm attachment portion 104, pins on the suppressor attachment portion 102 and/or the firearm attachment portion 104, or other mechanisms, devices, or structures.

Turning now to FIGS. 4A-4F, additional aspects of the concepts and technologies described herein for a hinged firearm suppressor mount 100 will be described in additional detail. In particular, FIGS. 4A-4F are drawings showing a hinged firearm suppressor mount 100 in use, according to some illustrative embodiments. In particular, with reference to FIG. 4A, the hinged firearm suppressor mount 100 can be attached, connected, mated, and/or otherwise located with respect to a firearm 400. In the illustrated embodiment, the hinged firearm suppressor mount 100 is attached to the barrel 300 of the firearm 400. A firearm suppressor 402 can be attached to the hinged firearm suppressor mount 100.

Figure 4A:
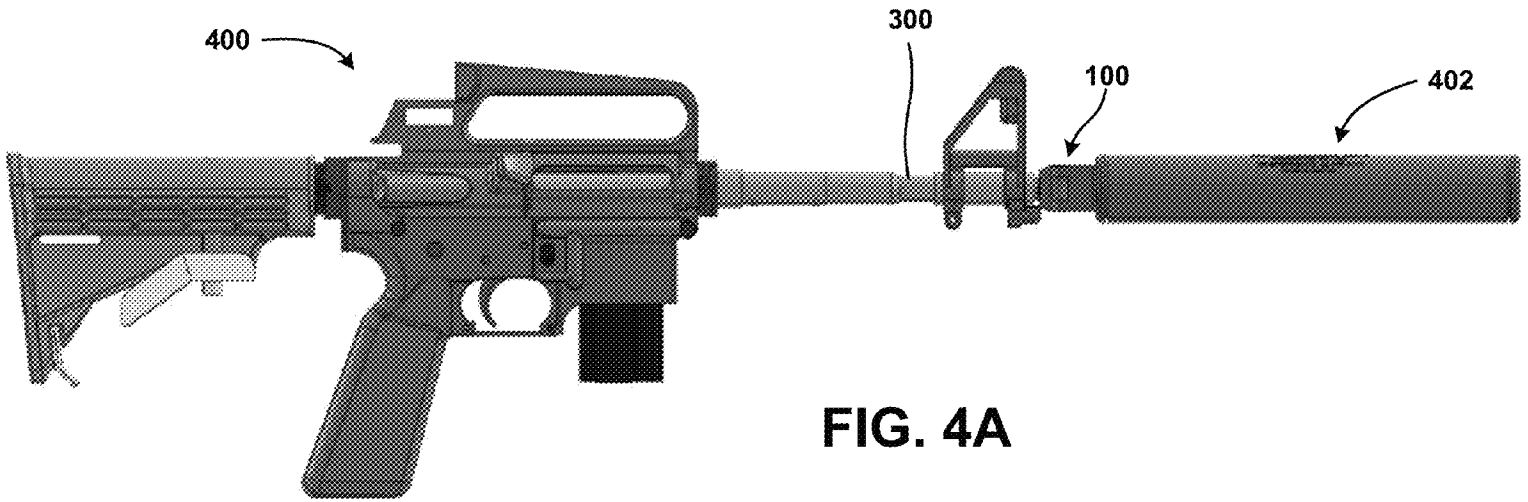
FIGS. 4A-4F are line drawings illustrating an example operating environment for the hinged firearm suppressor mount, according to some illustrative embodiments of the concepts and technologies described herein.
Figure 4B:
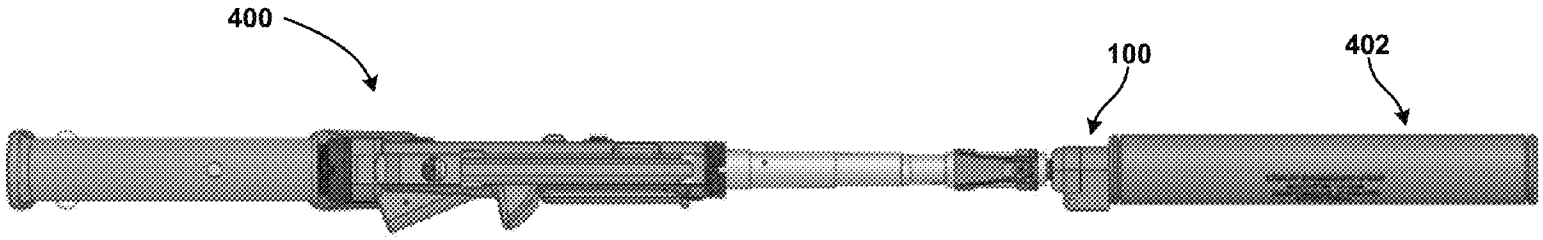
Figure 4C:
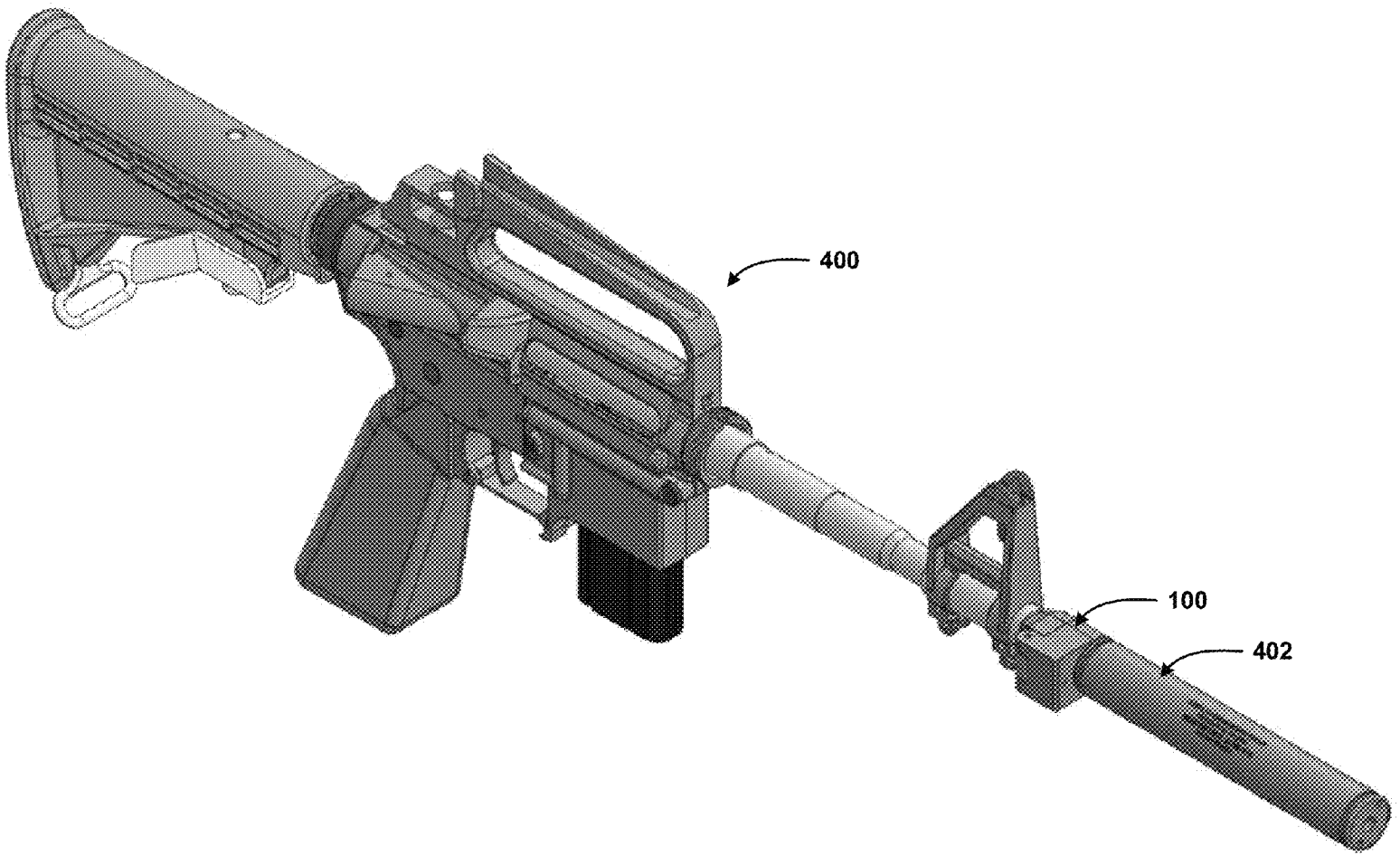

In FIG. 4A, the firearm suppressor 402 is shown in an operating position, i.e., a position at which the firearm suppressor 402 operates as intended to reduce a visible and/or audible signature of the firearm 400. In particular, by closing the hinged firearm suppressor mount 100 as illustrated and described above with reference to FIGS. 2A-2B, the firearm suppressor 402 can be located at the end of the barrel 300 such that a projectile fired from the firearm 400, as well as gases, heat, and the like, expand into the firearm suppressor 402. FIG. 4B illustrates another view of the arrangement of the firearm 400, the hinged firearm suppressor mount 100, and the firearm suppressor 402 as shown in FIG. 4A. FIG. 4C illustrates a perspective view of the arrangement of the firearm 400, the hinged firearm suppressor mount 100, and the firearm suppressor 402 as shown in FIGS. 4A-4B.

Figure 4D:
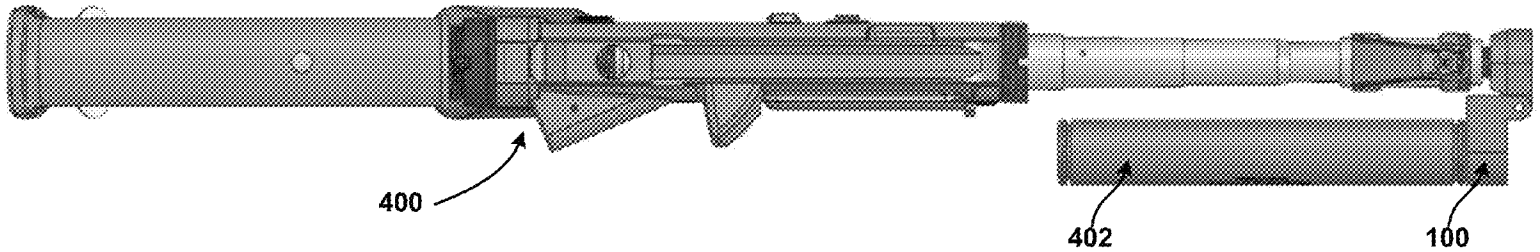
Figure 4E:
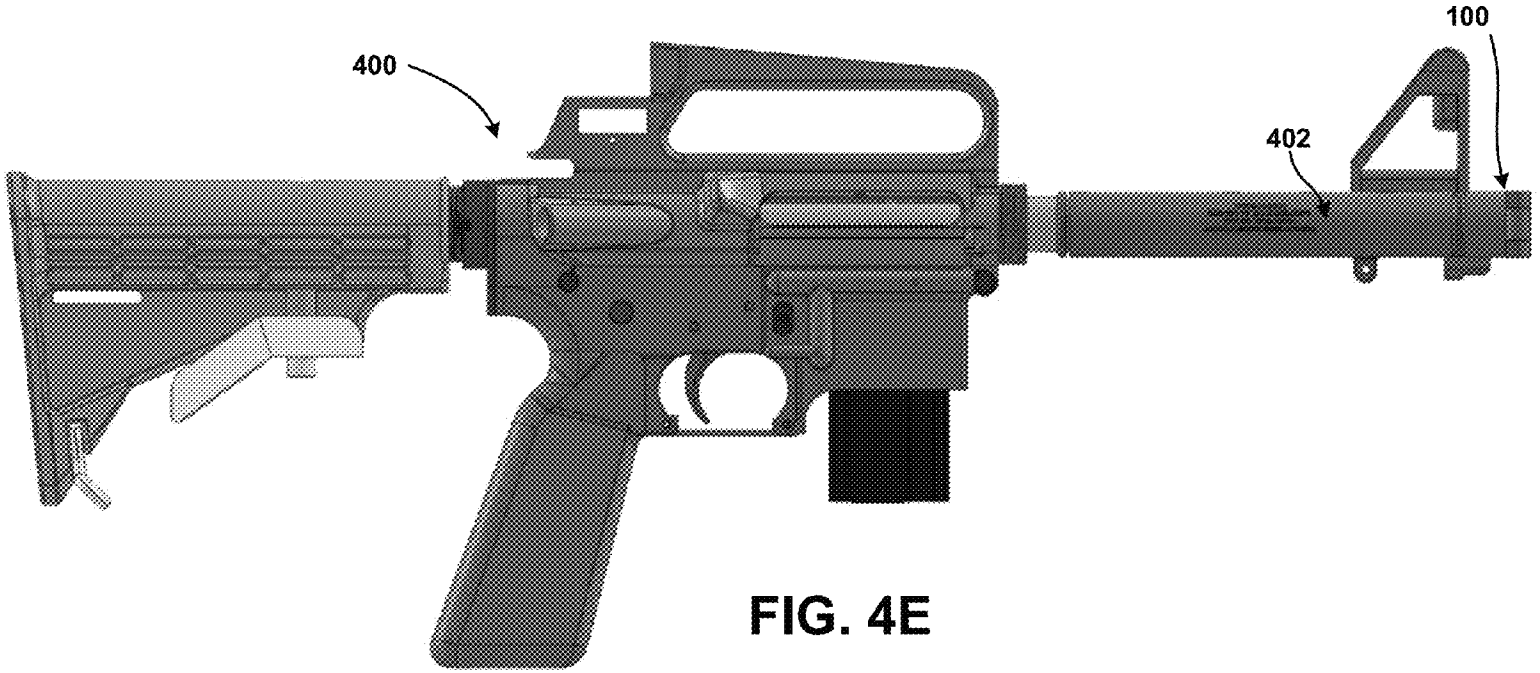
Figure 4F:
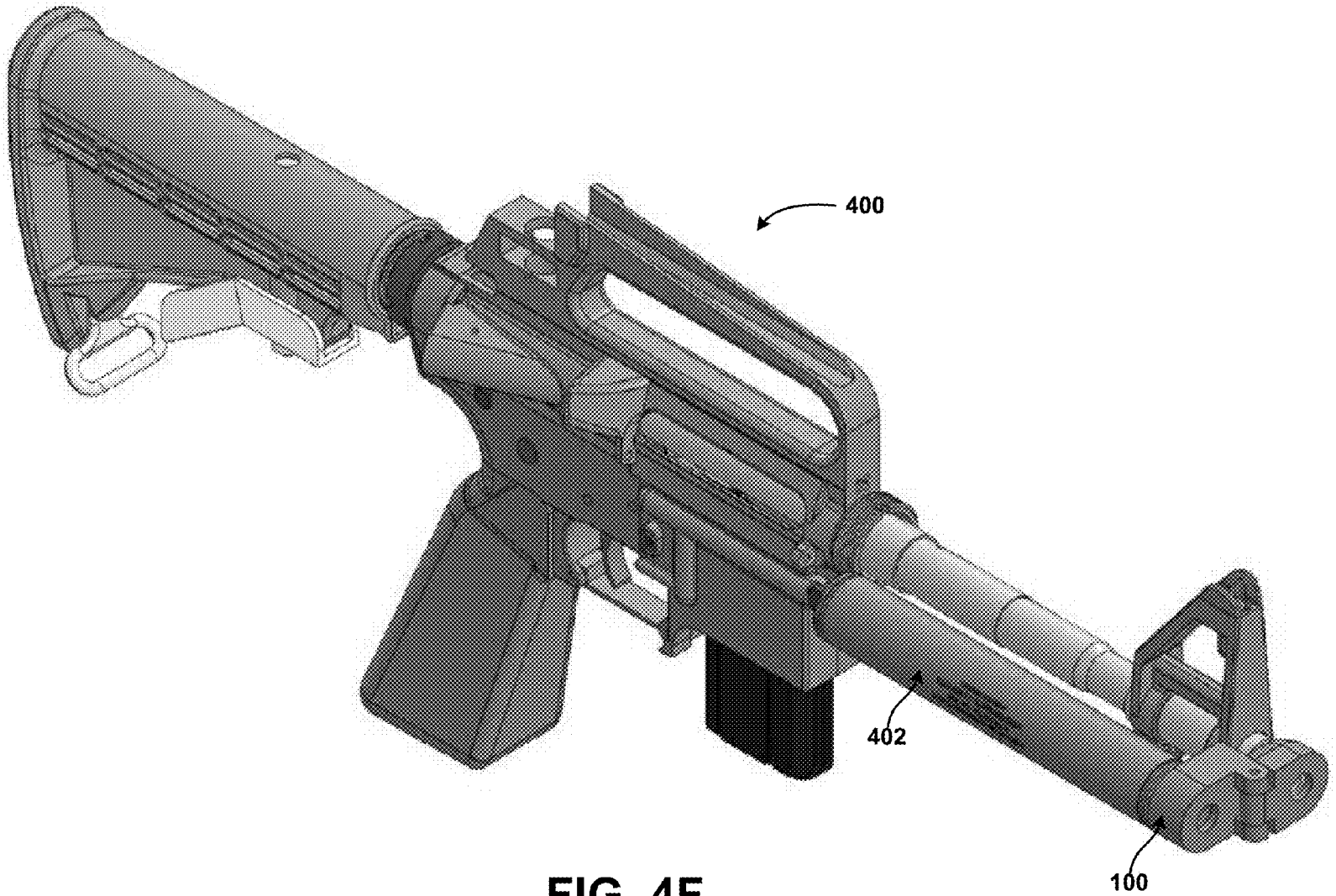

Turning now to FIGS. 4D-4F, rotation of the firearm suppressor 402 out of operating position is shown. In particular, the hinged firearm suppressor mount 100 has been opened in FIGS. 4D-4F to move the firearm suppressor out of the operating position described above. Thus, in the arrangement illustrated in FIGS. 4D-4F, a projectile fired from the firearm 400, as well as gases, heat, and the like, do not expand into the firearm suppressor 402. The arrangement shown in FIGS. 4D-4F, where the firearm suppressor 402 is out of operating position, may be used for various purposes.

For example, a user may rotate the firearm suppressor 402 out of operating position when the firearm 400 is set to full automatic, as some firearm suppressors 402 generally may be incapable of suppressing extended amounts of full automatic gunfire due to the intense heat and pressures associated with extended full automatic fire. In some embodiments, a firearm suppressor 402 may heat up an average of seven degrees per shot, and as such, extended automatic gunfire of one hundred shots would heat the suppressor about seven hundred degrees. It should be understood that this example is merely illustrative, and that some suppressors may be heated up more or less per shot depending upon the materials used to form the suppressor, the type and/or load of the ammunition, the length of the barrel of the firearm, combinations thereof, or the like. Regardless, various embodiments of the concepts and technologies described herein allow the firearm suppressor 402 to be rotated out of operating position to prevent damage to the firearm suppressor 402 under certain operating conditions.

In another example, a user may rotate the firearm suppressor 402 out of operating position when the firearm 400 or the firearm suppressor 402 are being cleaned to enable access to the barrel 300 of the firearm 400. In another example, a user may rotate the firearm suppressor 402 out of operating position when the firearm 400 or the firearm suppressor 402 is being transported and/or stored due to size restrictions, or the like. Because the firearm suppressor 402 may be rotated out of and/or into operating position for various purposes, it should be understood that these examples are illustrative and therefore should not be construed as being limiting in any way.

The hinged firearm suppressor mount 100 can also be used to provide a convenient storage location for a firearm suppressor 402. In particular, even if the firearm suppressor 402 is not being used at a particular time, the firearm suppressor 402 can be located at and/or stored with the firearm 400. Thus, the hinged firearm suppressor mount 100 can be used to simplify storage of the firearm suppressor 402, if desired. It should be understood that this example is illustrative and therefore should not be construed as being limiting in any way.

The hinged firearm suppressor mount 100 also can be used to shorten an amount of time needed to switch a firearm 400 from unsuppressed to suppressed or vice versa. Thus, for example, conversion of a firearm 400 between suppressed and unsuppressed fire, or vice versa, can be quick and easy (as quick as rotating a hinge), which can be useful in military, law enforcement, and/or sporting applications. It should be understood that this example is illustrative and therefore should not be construed as being limiting in any way.

The hinged firearm suppressor mount 100 can also be used to provide a convenient way to remove a damaged firearm suppressor 402 from a firearm 400. In particular, if the firearm suppressor 402 is damaged, the firearm suppressor 402 can rotated out of operation position. Thus, the hinged firearm suppressor mount 100 can be used to simplify removal of a damaged firearm suppressor 402, if desired. It should be understood that this example is illustrative and therefore should not be construed as being limiting in any way.

The hinged firearm suppressor mount 100 also can prevent and/or reduce sticking between a firearm suppressor 402 and a firearm 400, which is a known disassembly problem faced by users of firearm suppressors 402. In particular, existing quick disconnect firearm suppressor technologies rely upon Morse taper design to enable high tolerance locating of the firearm suppressor 402 and quick removal of the firearm suppressor 402. Embodiments of the concepts and technologies described herein, however, allow the firearm suppressor 402 to be moved out of operating position without actually removing the firearm suppressor 402 from a mounting surface. As such, embodiments of the concepts and technologies described herein can solve the problem of sticking (by not requiring disassembly of the firearm suppressor 402 from the firearm 400). It should be understood that this example is illustrative and therefore should not be construed as being limiting in any way.

The hinged firearm suppressor mount 100 also can support various attachment mechanisms and/or surfaces for various firearms 400 and/or firearm suppressors 402. Thus, some embodiments of the hinged firearm suppressor mount 100 can be used with any brand of firearm 400 and any brand of firearm suppressor 402. Thus, some embodiments of the concepts and technologies described herein can be used to provide universal (or nearly universal) mounting of firearm suppressors 402 to firearms 400. It should be understood that this example is illustrative and therefore should not be construed as being limiting in any way.

The hinged firearm suppressor mount 100 can also be used to support moving a firearm suppressor 402 from one firearm 400 to another firearm (not shown in the FIGURES). Thus, the hinged firearm suppressor mount 100 can be used to simplify removal of the firearm suppressor 402 from one firearm 400 and attachment of the firearm suppressor 402 to another firearm, if desired. It should be understood that this example is illustrative and therefore should not be construed as being limiting in any way.

In some embodiments, the hinged firearm suppressor mount 100 can be configured to engage a muzzle break, a silencer, and/or a flash suppressor in addition to, or instead of, the firearm suppressor 402 shown in the FIGURES. Thus, the hinged firearm suppressor mount 100 may not engage a barrel 300 of a firearm 400, in some embodiments. It should be understood that this example is illustrative and therefore should not be construed as being limiting in any way.

In some embodiments, the hinged firearm suppressor mount 100 has a total height (which can be measured between the end of the barrel 300 or other mounting surface of the firearm 400 and the mounting surface of the firearm suppressor 402; i.e., along the projectile path through a center of the surfaces 110, 112, 126, 128 shown in the FIGURES) of two inches. Existing quick disconnect technologies for firearm suppressors can require up to two extra inches, which can either add to the length of the baffle of a firearm suppressor or waste two inches of the baffle length. Thus, some embodiments of the hinged firearm suppressor mount 100 disclosed herein can save two inches or more of baffle length and/or overall length. It should be understood that this example is illustrative and therefore should not be construed as being limiting in any way.

While the above description has illustrated the hinged firearm suppressor mount 100 as having a hinge formed by hinge knuckles and a hinge pin, it should be understood that other types of hinge mechanisms are contemplated and are possible. In particular, some embodiments of the concepts and technologies described herein include hinges that can be opened without binding and/or that can be hidden from view (similar to cabinet hinges). Similarly, some other embodiments of the concepts and technologies described herein can include hinges that can be opened without taking additional side space (similar to refrigerator hinges). Yet other embodiments of the concepts and technologies described herein can include hinges that have multiple hinge planes to cantilever one or more of the suppressor attachment portion 102 and the firearm attachment portion 104 away from one another. Because other types of hinges and/or hinging mechanisms can be used in various embodiments of the concepts and technologies described herein, it should be understood that the illustrated and described embodiments are merely illustrative of some contemplated embodiments and therefore should not be construed as being limiting in any way.

Based on the foregoing, it should be appreciated that embodiments of a hinged firearm suppressor mount have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A hinged firearm suppressor mount comprising:

a firearm suppressor portion comprising an attachment surface and a first structure that houses a first assembly passageway;

a firearm attachment portion comprising a firearm attachment surface and a second structure that houses a second assembly passageway;

an assembly mechanism that passes through the first structure and the second structure, and that connects the firearm attachment portion to the firearm suppressor portion; and a latch that is used to lock the firearm attachment portion and the firearm suppressor portion in a position with respect to one another.

2. The hinged firearm suppressor mount of claim 1, wherein a firearm suppressor is attached to the firearm suppressor portion at the attachment surface.

3. The hinged firearm suppressor mount of claim 2, wherein the firearm suppressor is attached to the firearm suppressor portion via threads located at the attachment surface.

4. The hinged firearm suppressor mount of claim 1, wherein a firearm is attached to the firearm attachment portion at the firearm attachment surface.

5. The hinged firearm suppressor mount of claim 4, wherein the firearm is attached to the firearm attachment portion via threads located at the firearm attachment surface.

6. The hinged firearm suppressor mount of claim 1, wherein the first structure comprises a first knuckle, wherein the second structure comprises a second knuckle, and wherein the assembly mechanism comprises a hinge.

7. The hinged firearm suppressor mount of claim 1, wherein the firearm suppressor portion comprises a tapered surface.

8. The hinged firearm suppressor mount of claim 1, wherein the attachment surface comprises a plurality of attachment surfaces.

9. The hinged firearm suppressor mount of claim 1, wherein the firearm attachment surface comprises a plurality of attachment surfaces.

10. The hinged firearm suppressor mount of claim 1, further comprising a gasket located between the firearm attachment portion and the firearm suppressor portion.

11. A hinged firearm suppressor mount comprising:

a firearm suppressor portion comprising an attachment surface and a first structure comprising a first assembly passageway;

a firearm attachment portion comprising a firearm attachment surface and a second structure comprising a second assembly passageway; and an assembly mechanism that passes through the first assembly passageway and the second assembly passageway, wherein the assembly mechanism connects the firearm attachment portion to the firearm suppressor portion, and wherein the assembly mechanism provides an axis about which at least one of the firearm attachment portion and the firearm suppressor portion rotates.

12. The hinged firearm suppressor mount of claim 11, wherein the first structure comprises a first knuckle, wherein the second structure comprises a second knuckle, and wherein the assembly mechanism comprises a hinge.

13. The hinged firearm suppressor mount of claim 11, wherein a firearm suppressor is attached to the firearm suppressor portion at the attachment surface, and wherein a firearm is attached to the firearm attachment portion at the firearm attachment surface.

14. The hinged firearm suppressor mount of claim 13, wherein the firearm suppressor can be moved into and out of an operating position by rotating the firearm attachment portion or the firearm suppressor portion about the axis.

15. A hinged firearm suppressor mount comprising:

a firearm suppressor portion comprising an attachment surface that engages a firearm suppressor and a first assembly passageway;

a firearm attachment portion comprising a firearm attachment surface that engages a firearm and a second assembly passageway; and an assembly mechanism that passes through the first assembly passageway and the second assembly passageway, wherein the assembly mechanism connects the firearm attachment portion to the firearm suppressor portion, and wherein the assembly mechanism provides an axis about which at least one of the firearm attachment portion and the firearm suppressor portion rotates.

16. The hinged firearm suppressor mount of claim 15, further comprising:

a first knuckle in which the first assembly passageway is located; and a second knuckle in which the second assembly passageway is located, wherein the assembly mechanism comprises a hinge.

17. The hinged firearm suppressor mount of claim 15, wherein the firearm suppressor is attached to the firearm suppressor portion at the attachment surface, and wherein the firearm is attached to the firearm attachment portion at the firearm attachment surface.

18. The hinged firearm suppressor mount of claim 15, wherein the firearm suppressor can be moved into an operating position and out of the operating position by rotating the firearm attachment portion or the firearm suppressor portion about the axis.

* * * * *